United States Patent [19]

Shimizu et al.

[11] 4,244,176

[45] Jan. 13, 1981

[54] DEVICE FOR WAXING A YARN

[75] Inventors: Takeshi Shimizu, Kariya; Kinpei Mitsuya, Aichi, both of Japan

[73] Assignee: Kabushiki Kaisha Toyoda Jidoshokki Seisakusho, Kariya, Japan

[21] Appl. No.: 25,442

[22] Filed: Mar. 27, 1979

[30] Foreign Application Priority Data

| | | | |
|---|---|---|---|
| Apr. 5, 1978 | [JP] | Japan | 53/39946 |
| Apr. 11, 1978 | [JP] | Japan | 53/47335[U] |
| Apr. 13, 1978 | [JP] | Japan | 53/48608[U] |
| Apr. 17, 1978 | [JP] | Japan | 53/50641[U] |

[51] Int. Cl.[3] ..... D01H 13/30; D02J 3/18; B65H 71/00

[52] U.S. Cl. ..... 57/295; 57/20; 118/78

[58] Field of Search ..... 57/20, 295, 296; 118/76, 77, 78

[56] References Cited

U.S. PATENT DOCUMENTS

| | | | |
|---|---|---|---|
| 1,856,198 | 5/1932 | Swanson | 118/78 |
| 2,282,888 | 5/1942 | Russo | 118/78 |
| 2,474,346 | 6/1949 | Coleman et al. | 118/78 |
| 3,590,568 | 7/1971 | Kubovy et al. | 57/295 |
| 3,890,924 | 6/1975 | Horstmann | 118/78 |
| 4,046,102 | 9/1977 | Piro | 118/78 |

FOREIGN PATENT DOCUMENTS

| | | |
|---|---|---|
| 599991 | 12/1977 | Fed. Rep. of Germany . |
| 1341947 | 6/1971 | U.S.S.R. . |

*Primary Examiner*—Donald Watkins

*Attorney, Agent, or Firm*—Wenderoth, Lind & Ponack

[57] ABSTRACT

A device for waxing a yarn in a spinning machine which includes an annular wax roll, and means for rotatably supporting the wax roll. The support means includes a solid cylindrical member integrally connected to the wax roll so as to project from one end of the wax roll, and a support spindle associated with the cylindrical member for allowing the integral rotation of the cylindrical member and the wax roll. The waxing device is disposed that the yarn, which travels from a supply of yarn to a yarn winding-up mechanism, contacts both the projected periphery of the cylindrical member and the one end of the wax roll. The rotation of the wax roll is caused mainly by the yarn contacting the solid cylindrical member so that the wax roll is not adversely affected by the yarn even when changes occur in the travel condition of the yarn, so that no grooves or concaved lines are formed in the end face of the wax roll.

The wax roll can be retracted from an operative or waxing position, in which the yarn contacts the wax roll during the normal spinning operation, so that the wax roll is kept away from the yarn during a yarn piecing operation and doffing operation, thereby removing factors which cause the irregular rotation of the wax roll and the formation of grooves in the end face of the wax roll.

Additionally, the waxing devices can automatically bring the yarn into a proper waxing position, in which the yarn is in contact with both the wax roll and the solid cylindrical member, after the yarn piecing operation and the doffing operation.

20 Claims, 9 Drawing Figures

FIG. 2
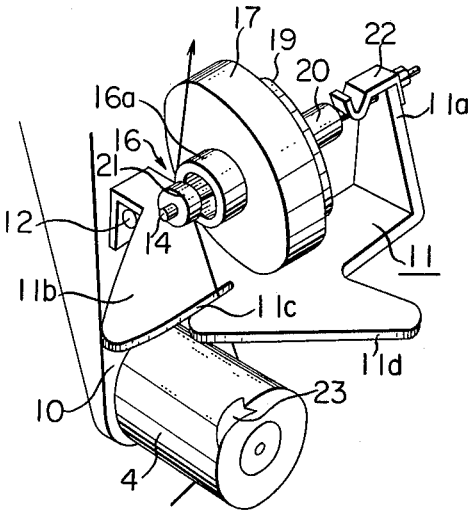
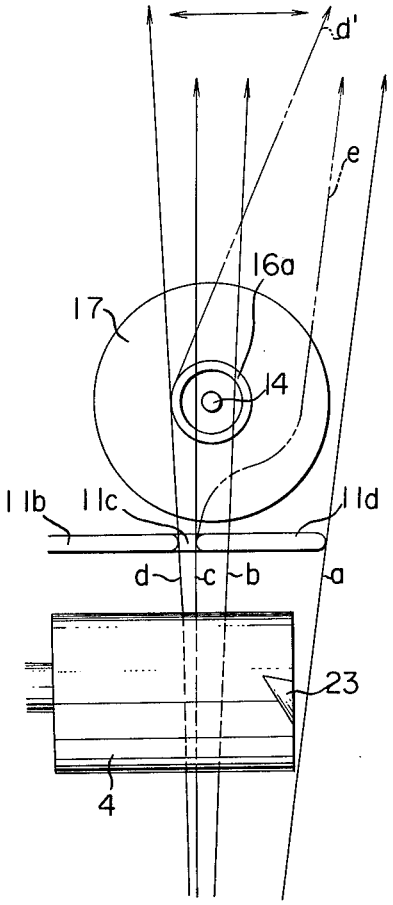
FIG. 3
FIG. 4
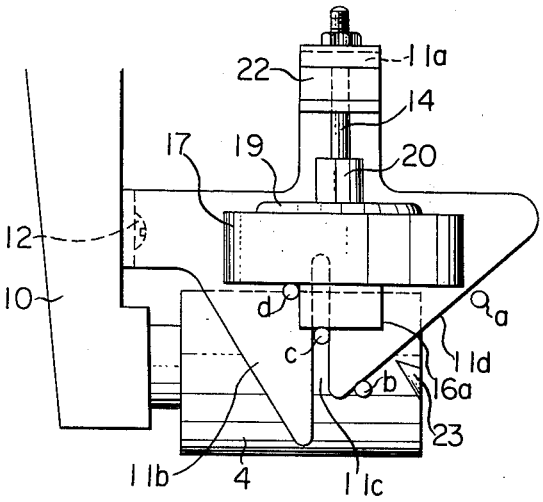

DEVICE FOR WAXING A YARN

BACKGROUND OF THE INVENTION

This invention relates to a device for waxing a yarn by utilizing a travel of the yarn.

A yarn which is produced by a spinning machine and wound onto a bobbin is normally eventually assembled into a woven fabric or a knitted cloth by a weaving machine or a knitting machine. However, especially during a knitting operation, the yarn is subjected to a considerable frictional resistance when it comes in with knitting needles and/or guides which are in operation at a high speed. Such a resistance causes yarn breakage and napping, which results in a hindrance to the operation of the knitting machine and in knitting defects. Therefore, in order to eliminate the abovementioned disadvantages of the weaving machine and/or the knitting machine, the yarn has conventionally been waxed to improve smoothness before being wound onto the bobbin, and there have been provided various designs for devices for waxing yarn. Yarn waxing devices must be capable of waxing the yarn uniformly during the yarn winding-up in the spinning machine and must be inexpensive because the device has to be provided for each one of a number of spindles or spinning units of the spinning machine.

Since the waxing can be achieved by adhesion of paraffin molecules of the wax to the yarn, the wax is reduced in volume due to coming into contact with the yarn and as a result of a change in configuration. It is understood therefore, the condition under which the wax is in contact with the yarn changes with time. To accommodate such a change in contact condition, there have been provided various designs for a waxing device, one of which employs an annular wax roll or body supported for rotation to allow for it to be rotated by the yarn, which travels while contacting only the end face of the wax roll. For example, British Pat. No. 1,341,947 and Swiss Pat. No. 599,991 disclose the abovedescribed type of waxing devices.

One feature resulting from rotating the wax roll by with the yarn travel is that it is required that the wax roll be moved integrally with the yarn. Another feature resulting from waxing the yarn is that a strong relative movement is required between the yarn and the wax roll. However, with the aforesaid prior art devices, these conflicting requirements could not be satisfied because the rotation of the wax roll was caused only by the contact of the yarn with the wax roll. In such a wax driving system, the rotation of the wax roll was adversely affected by various factors, such as conditions of the end face of the wax roll with which the yarn comes in contact a uniform change in the distribution of weight of the wax roll with respect to the radial direction thereof, a sliding of the contact line, along which the yarn travels while contacting the wax roll, due to the transverse motion of the yarn, and a change in tension of the yarn. More particularly, the rotation of the wax roll was not smooth in spite of the use of a bearing means for the wax roll, and during normal spinning operation of the spinning machine there occurred an undesirable phenomenon wherein the wax roll repeatedly rotated in a intermittent fashion. This was due to several grooves or concave lines which were formed in the end face of the wax roll by the travelling yarn. As a result, the yarn was periodically caught in these grooves to temporarily prevent the rotation of the wax member and thereafter released therefrom when a portion of the yarn not caught by the grooves became oriented a certain angle with respect to the associated groove due to a transverse motion of the yarn and thereby, causing the wax roll to rotate again. As a result, the contact condition of the yarn with the wax roll became more uneven and the grooves became much more developed. The yarn was allowed to become subjected to less waxing and finally, could not be released from the grooves and thus, resulting in the cutting off of the wax roll.

Furthermore, in the described type of waxing device wherein the rotation of the wax roll relies only upon the contact thereof with the yarn, there occurred further problems during yarn travelling other than those occurring during the aforesaid normal spinning operation, such as during yarn piecing operations and doffing operations. For example, during the doffing operation, the yarn travelling, which is to be connected at its end to an empty bobbin, is under constant changing conditions in that tension is either greatly increased or loosened. Therefore, not only does the contact pressure of the yarn to the wax roll greatly vary, but also a definite position of the yarn in which the yarn properly contacts the wax roll can not be maintained. When the excessive tension is abruptly generated in the yarn, grooves or concaved lines will be formed in the end face of the wax roll. In contrast to the above, when the yarn is loosened so that it is shifted away from its normal path of travel, there is a possibility that the yarn will not return to the normal path of travel. If that occurs, the yarn is incapable of rotating the wax roll.

In addition, it can be understood that after the yarn piecing or doffing operation, the yarn is required to be smoothly transferred to its normal path of travel which allows for a proper contact of the yarn with the wax roll, otherwise the waxing device will not exhibit good waxing properties.

SUMMARY OF THE INVENTION

It is therefore a principal object of this invention to provide a device for waxing a yarn, in which an uniform rotation of wax roll is established to exhibit a good waxing properties during an effective lifetime thereof.

To accomplish this, the device for waxing a yarn includes an annular wax roll, means for supporting the wax roll, and means for supporting the wax roll for rotation. The support means includes a solid cylindrical member which is integrally connected to the wax roll so as to project from one end of the wax roll, and a support spindle associated with the cylindrical member in a manner which allows the integral rotation of the cylindrical member and the wax roll. The waxing device is disposed so that the yarn, which travels from a supply of yarn to a yarn winding-up mechanism, come in contact with both the projected periphery of the cylindrical member and one end of the wax roll. Since the rotation of the wax roll is caused mainly by the contact of the yarn with the solid cylindrical member, the wax roll is not adversely affected by the yarn even when any change occurs in yarn travel conditions so that no grooves or concaved lines are formed in the end face of the wax roll.

According to a preferred embodiment of the invention, the wax roll can be retracted from an operative or waxing position, in which the yarn is in contact with the wax roll during the normal spinning operation, in order that the wax roll is kept away from the yarn during a yarn piecing operation and doffing operation, thereby removing factors causing the irregular rotation of the wax roll and the formation of grooves in the end face of the wax roll.

According to another preferred embodiment of this invention, the waxing device is capable of bringing the yarn automatically into a proper waxing position, in which the yarn is in contact with both the wax roll and the solid cylindrical member, after the yarn piecing operation and the doffing operation.

BRIEF DESCRIPTION OF THE DRAWINGS

This invention will become more readily apparent from the following description taken with reference to the preferred embodiments thereof which are shown in the accompanying drawings, in which:

FIG. 2 is a perspective view showing certain essential parts of the waxing device of the present invention;

FIG. 3 is a front elevation view of the essential parts of the waxing device shown in FIG. 2, showing various paths of travel of a yarn;

FIG. 4 is a plan view of FIG. 3;

DESCRIPTION OF THE PREFERRED EMBODIMENTS

Figure 1B:
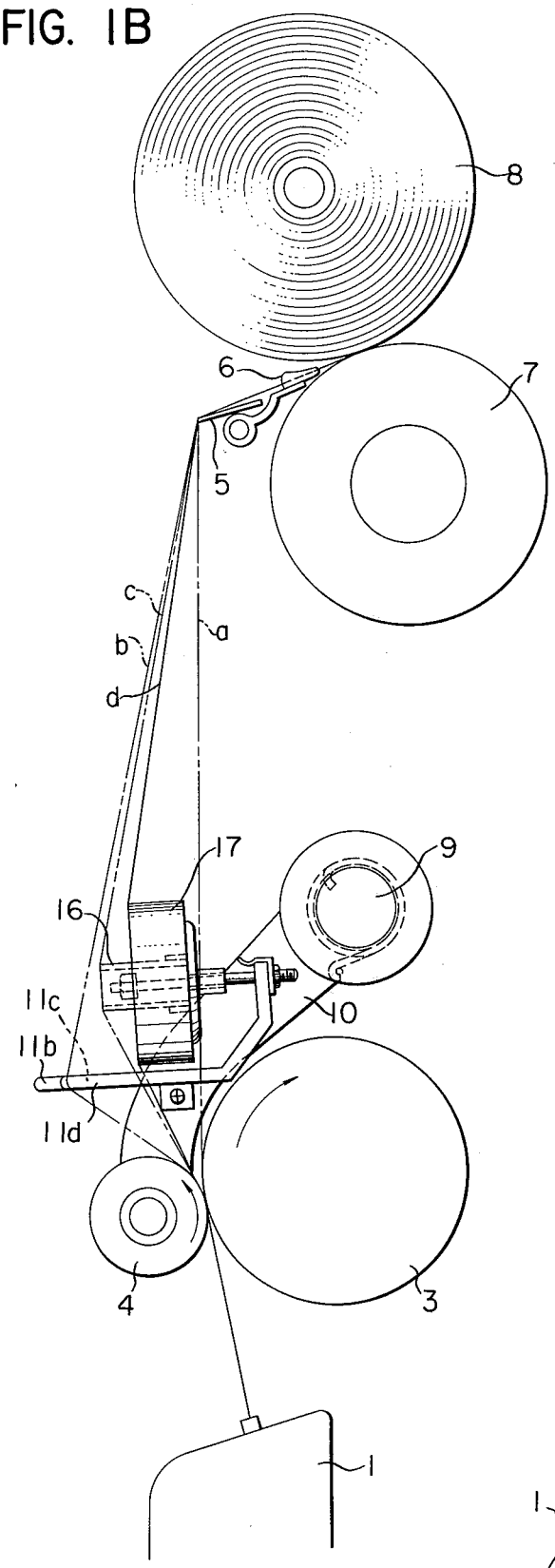
FIG. 1B is a view corresponding to that of FIG. 1A, showing a modification of the invention.
Figure 1A:
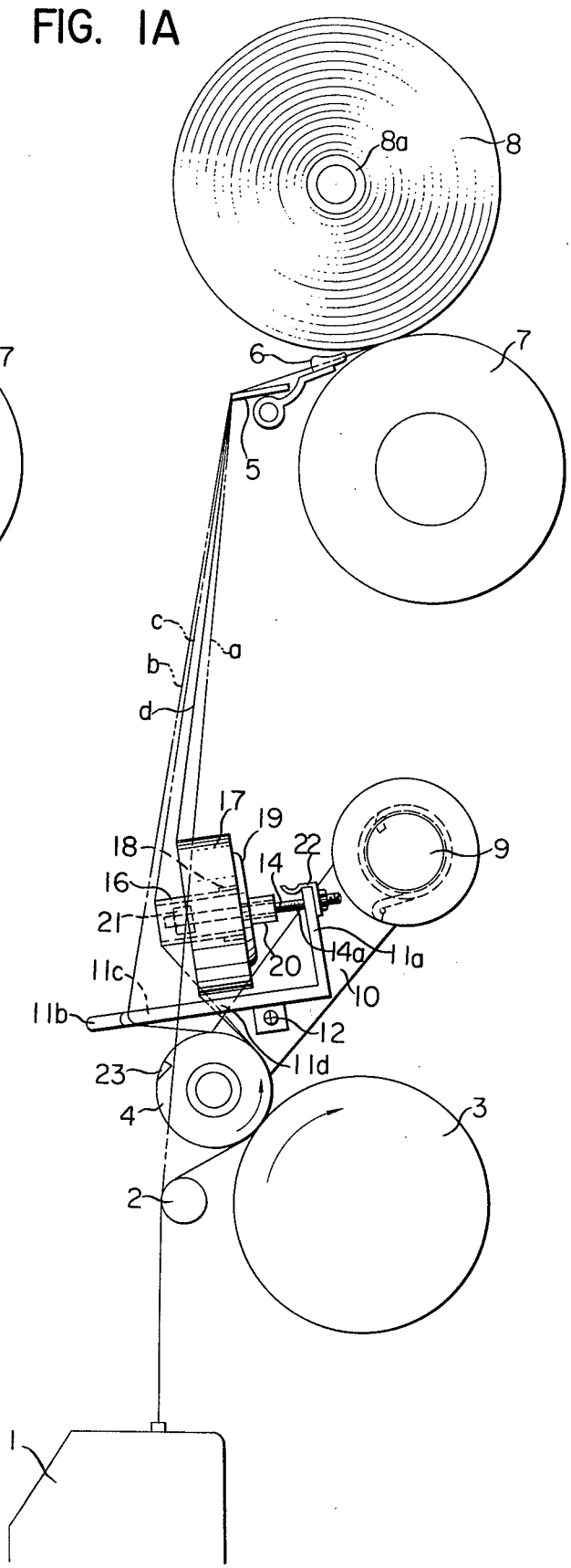
FIG. 1A is a side elevation view of a waxing device according to the present invention.

Referring now to FIG. 1A, there is shown a waxing device which is installed in a spinning machine, e.g., an open end spinning machine, in which a spun yarn which is produced in a known manner by a spinning unit 1, is taken up through a guide 2, by a yarn take-up which includes a lower take-up roller 3 and an upper pressure roller 4 which is in pressure contact with the lower roller 3. Subsequently, the yarn passes through a known guide 5 for accommodating a change in tension of the yarn and a traverse guide 6—6 and it is wound onto a package 8 driven which is by a winding-up mechanism including a driving roller 7, which is in driving contact with the package 8.

In such a spinning machine, the waxing device is disposed between the yarn take-up mechanism and the yarn winding-up mechanism, and is provided for each spinning unit 1 (only one is shown in the figure). In the embodiments of FIGS. 1A and 1B, the waxing device includes a bracket 11*a* to 11*d* which is fixedly mounted, as shown at 12, on a spring loaded support lever 10, which rotatably supports the pressure roller 4 at one end and which is pivotally connected to a stationary shaft 9 at the other end. The bracket 11 has a first vertical arm 11*a* and a second horizontal arm 11*b* which extends substantially perpendicular to the first arm 11*a*. The first arm 11*a* acts as a mounting plate, and the second arm 11*b* has with a yarn restricting notch 11*c* (FIG. 2) which extends along a portion of the second arm 11*b*, and a yarn guide end face 11*d* which is inclined with respect to the notch 11*c*.

An annular wax roll 17 is supported by support means. The support means includes a stationary spindle 14 which is adjustably mounted on the first arm 11*a* so as to extend substantially parallel to the second arm 11*b*, and a wax mounting hollow cylindrical member or sleeve 16 which is loosely fitted onto the spindle 14 and fixedly fitted into the wax roll 17 in a manner as described below.

Figure 6A:
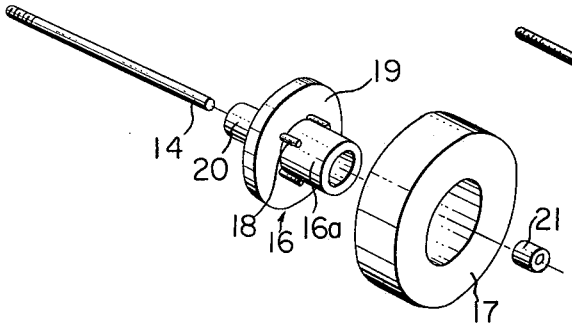
FIG. 6A is an exploded perspective view of the waxing device shown in FIG. 1A.

In FIGS. 1A and 6A, the wax mounting sleeve 16 is shown and is preferably an integral one-piece unit which includes first portion 16*a* which is inserted into the wax roll 17, a suitable number of axially extending projections 18 (in this embodiment, five projections are provided, although only three are shown) which are disposed circumferentially around the inner end of the first portion 16*a* to prevent rotation of the wax roll 17 relative to the wax mounting sleeve 16, a flange-like portion 19 which acts are shown for defining the axial position of the wax roll 17 relative to the first portion 16*a*, and a second portion 20 having an inner diameter larger than the outer diameter of the stationary spindle 14. When assembling the aforedescribed spindle 14, wax roll 17 and mounting sleeve 16 into the waxing device, the first portion 16*a* of the wax mounting sleeve 16 is inserted into the wax roll 17 which axially chips the inner cylindrical surface of the wax roll 17 with the projections 18, until the inner end of the wax roll 17 abuts against the flange-like portion 19, whereupon the wax mounting sleeve 16 is integrally fitted into the wax roll 17 with the first portion 16*a* projecting from the other outer end of the wax roll 17. Subsequently, the support spindle 14 is inserted through the second portion 20 into the first portion 16*a* in a manner which allows the wax roll 17 and mounting sleeve 16 to rotate about and slide along the support spindle 14 as a single unit. To prevent the integrally assembled wax roll 17 and mounting sleeve 16 from slipping out of the support spindle 14, a stop 21 which is made of, for example, rubber, is fixedly connected at the free end of the spindle 14. The stop 21 has an outer diameter which is smaller than the inner diameter of the first portion 16*a* and larger than the inner diameter of the flange-like portion 19 or second portion 20. The wax roll 17 is preferably placed in an inclinded condition with respect to the vertical plane, and a desired angle of inclination can be formed between the plane of rotation of the wax roll 17 and the vertical plane by adjusting the screw 12. Such an inclination is provided for causing a sufficient contact pressure between the yarn and the outer end face of the wax roll 17 for achieving a satisfactory waxing of the yarn. Alternatively, the contact pressure can be provided by a spring, which would be disposed, for example, between the first arm 11*a* of the bracket 11 and the second portion 20 of the wax mounting sleeve 16.

The wax mounting sleeve 16 is made of wear resisting material, such as metals, wood, rubber, or plastics. At least the first portion 16*a* of the wax mounting sleeve 16 is preferably made of synthetic resin, such as polyamide including, for example, Nylon, which has sufficient wear resisting characteristics so as to not be worn away during contact with the yarn, and has a sufficient frictional resistance relative to the yarn to cause the integral rotation of the wax roll 17 and wax mounting sleeve 16.

With the aforementioned waxing device according to the invention, the wax roll 17 can be rotated integrally with the wax roll mounting sleeve 16 during the entire waxing operation because of the firm engagement of the projections 18 with the wax roll 17. It is difficult to wear away the wax mounting sleeve 16 through its contact with the yarn because it is a wear resistive rigid member which is made of, for example, plastics, and any wax roll 17 can be maintained in a fixed position because of the presence of the stop 19. The above secondary feature of the wax mounting sleeve 16 advantageously contributes to a lightness of the sleeve 16, this being a necessary feature for rotating the sleeve 16 by means of the contact of the travelling yarn with the sleeve, and which also contributes to a decrease in the manufacturing cost thereof.

In the normal spinning operation of the described spinning machine, the yarn, which is shown by a solid line d in FIG. 1A, is continuously taken up by the yarn take-up mechanism comprising which includes the yarn take-up roller 3 and the pressure roller 4, and travels through the nip formed therebetween and through the yarn restricting notch 11*c*, to the winding-up mechanism while traversing and being pushed in the lefthand direction, as shown in FIG. 1A, under the influence of the weight of the wax roll 17 and the wax mounting sleeve 16. Although the yarn is traversing between the paths d and d', as seen from FIG. 3, it is always substantially in contact with the cylindrical surface of the first portion 16*a* of the wax mounting sleeve 16, because the yarn restricting notch 11*c* is arranged below the wax roll 17, so that the wax mounting sleeve 16, and hence the wax roll 17, can be rotated by the travelling yarn. Thus, it can be understood that the uniformity of contact can be maintained between the yarn and the wax roll 17, thus resulting in the yarn being always waxed under optimum conditions. Since the wax mounting sleeve 16, which contributes mainly to the rotation of the wax roll 17, is wear resisting and therefore, does not change in configuration, the uniform transmission of rotation from the wax mounting sleeve 16 to the wax roll 17 can be maintained for the overall effective life of the wax roll 17, even if a greater or lesser change in the tension occurs in the travelling yarn. Thus, in the end face of the wax roll, there occur no grooves or concaved lines as occur in the wax roll which supported by the prior art waxing devices as a result of the change in tension of the yarn and the temporary stoppage of wax roll rotation.

Figure 5:
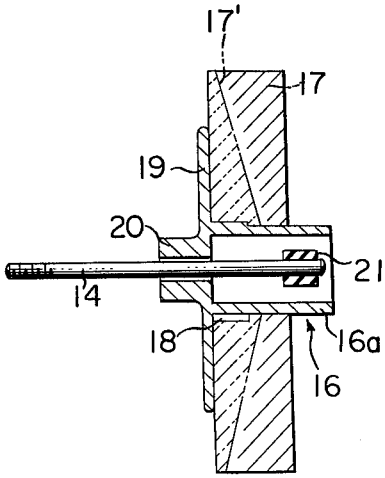
FIG. 5 is a side elevational view showing, in cross-section, an assembly of a wax roll and a wax mounting sleeve according to this invention.

During the aforedescribed normal spinning operation, the yarn follows a path d, as shown in FIG. 1A, and it curves when passing over diametrically opposed portions on the circumferential edge of the wax roll 17. As a result, at said portions, the wax roll 17 is subjected to a stronger contact pressure which causes more paraffin molecules to be adhered to the yarn. Therefore, at a time shortly before the end of the effective life of the wax roll 17, the outer end face of the wax roll 17 develops a crown shaped contour 17', as illustrated in FIG. 5, which contour has an advantage in that the time when the projections 18 become exposed to the yarn can be delayed.

When the package 8 (FIG. 1A) of the thus waxed yarn becomes full, the doffing operation has to be carried out. At the beginning of the doffing operation, the yarn is cut off from the full package, and the resultant cut end on the side of the spinning unit 1 is at once sucked by a sucker (not shown). Depending on the position of the sucker, the yarn can follow a path in which it is allowed to contact both the wax mounting sleeve 16 and wax roll 17, but it is not capable of causing them to rotate because the suction of the sucker does not provide the yarn with a sufficient tension to do so. In this case, grooves or concaved lines are produced in the end face of the wax roll 17 and this results, in spite of the presence of the wax mounting sleeve 16, in the rotation of the wax roll being prevented even during the successive normal spinning operation. In the doffing operation, then, the yarn running from the spinning unit 1 into the sucker must be transferred and connected to an empty bobbin 8*a*. At that time, the yarn is in a transient condition in which it is under either a great or loose tension. Therefore, not only does the contact pressure of the yarn to the wax roll vary greatly, but the definite position of the yarn in which the yarn properly contacts the wax roll can not be maintained. When the excessive tension is abruptly generated in the yarn, the grooves or concaved lines will be formed in the end face of the wax roll. In contrast to the above, when the yarn is loosened excessively so that it is shifted, as shown by a line e in FIG. 3, away from its normal path of travel d, there is a possibility that the yarn becomes incapable of returning to the normal path of travel d after the doffing. If this occurs, the yarn can not rotate the wax mounting sleeve 16 and as a result the wax roll 17. The above explanation regarding the doffing operation is also applicable to the yarn piecing operation.

Figure 7:
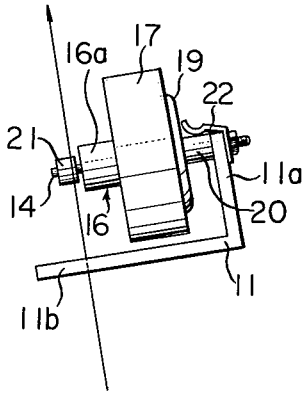
FIG. 7 is a side elevation view of the waxing device shown in a retracted position.

Thus, it is understood that it is preferable that the aforedescribed waxing device be maintained in a retracted or inoperative position during the doffing operation and during the yarn piecing operation. The waxing device in the retracted position is shown in FIG. 7, wherein the yarn does not come in contact with at least the wax roll 17.

In order to provide a sufficient space to receive the wax roll 17, which is in the retracted position, the support spindle 14 has a length which is sufficient for leaving a vacant portion 14*a* (FIG. 1A) adjacent the first vertical arm 11*a* of the bracket 11 when the wax roll 17 is in the aforedescribed operative position. When the wax roll 17 is in the retracted position, the vacant portion 14*a* is occupied by the second cylindrical portion 20 of the wax mounting sleeve 16 as shown in FIG. 7. To hold the wax roll 17 in the retracted position, a resilient holding member 22 is disposed on the free end of the bracket 11. The holding member 22 has a semicircular shape to facilitate the entire thickness of the wall of the second portion 20 to slide into a gap between the holding member 22 and the vacant portion 14*a* of the support spindle 14.

When the doffing operation or yarn piecing operation is to be carried out, it is required that an operator only force the wax mounting sleeve 16, as well as the wax roll 17, into the retracted position by sliding them along the support spindle 14 into the holding member 22 until it abuts against the vertical portion 11*a* of the bracket 11, whereupon the second portion 20 of the wax mounting sleeve 16 forces the holding member 22 upwardly against the resilience thereof, causing the wax mounting sleeve 16 and therefore the wax roll 17 to be held in the retracted position. When it is required to wax the yarn, the wax mounting sleeve 16, as well as the wax roll 17, is merely pulled out, whereby the second portion 20 is disengaged from the holding member 22, allowing the wax roll 17 to be brought into the waxing position.

In the meantime, it is noted that, for example, in the yarn piecing operation, the ring of fibres collected on a maximum diameter surface of a not shown open end rotor of the spinning unit is pulled out therefrom by twisting the fibre ring in a tail end of a yarn, which is first directly carried to the yarn winding-up mechanism without engaging in the yarn take-up mechanism and the waxing device. Well known, the engagement of the yarn with the yarn take-up mechanism is thereafter carried out automatically by yarn catching means. One example of such yarn catching means is a notch 23 (see FIGS. 2 to 4) which is provided in the edge of the pressure roller 4. The notch 23 catches the traversing yarn and causes it to be brought into the nip between the take-up roller 3 and the pressure roller 4 in a known manner. FIG. 1B shows another example of yarn catching means, wherein the yarn contacts only a portion of the circumferential surface of the take-up roll 4 before coming to the yarn winding-up mechanism so that the yarn can be brought into the nip as a result of an increase in the tension of the yarn which is caused by the contact of the yarn with the yarn take-up roller 3.

According to this invention, the yarn can be automatically placed in a waxing position by utilizing the aforementioned yarn restricting arm 11*b* (FIG. 2) and with assistance from the yarn catching means and the transverse motion of the yarn.

Such an automatic placement of the yarn will be explained hereinafter with reference to a spinning machine which includes a yarn catching device in the form of a notch 23 as provided in the pressure roller 4 shown in FIG. 1.

Figure 6B:
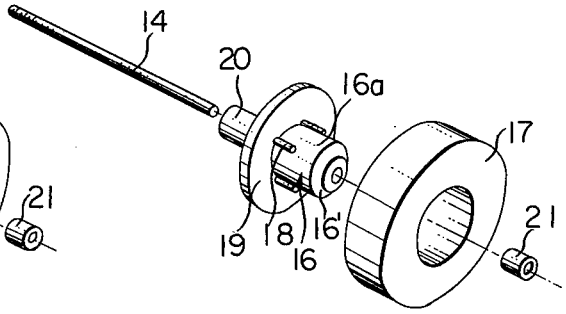
FIG. 6B is a view corresponding to FIG. 6A, showing another modification of the invention.

Referring to FIG. 1A, immediately after the tail end of the yarn is connected to the fibre ring, at which time the wax roll 17 may or may not have been placed in the retracted position together with the wax mounting sleeve 16 (see FIG. 7), the pieced yarn is fed directly from the spinning unit 1 to the yarn winding-up mechanism while following a path a (FIG. 1A) which extends beside one end face of the take-up roll 4. At that time, the yarn is being moved transversly by the traverse guide 6 and therefore, it is displaced toward the other end face of the pressure roller 4 for being engaged in the notch 23, thereby causing it to be nipped between the take-up roller 3 and the pressure roller 4. When the yarn is nipped, if the wax roll 17 and wax mounting sleeve 16 are not in the retracted position, it becomes necessary to prevent contact of the yarn with the cylindrical surface of the first portion 16*a* of the wax mounting sleeve 16, so that a position, at which the guide surface 11*d* intersects the yarn restricting notch 11*c*, is located ahead of the end face of the first portion 16*a*, as clearly shown in FIG. 4. Therefore, the yarn which is engaged in the notch 23 of the take-up roller 3, slides along the guide surface 11*d*, as shown by a letter b in FIG. 4, without contacting the first portion 16*a*, and is placed in the tensioned condition. Subsequently, the yarn approaches the yarn restricting notch 11*c* and is caused to enter the notch 11*c*, as shown by letter c in FIGS. 1A, 3 and 4, due to its tensioned condition. When the yarn is in the position c, it contacts the end face of the first portion 16*a*, if the wax mounting sleeve 16 is in the projected position. At that time, however, since the yarn is being transverse about the yarn restricting notch 11*c* at a relatively large angle, and since it is still in the highly tensioned condition as a result of its contact with the end face of the first portion 16*a*, the yarn can be easily brought into the normal path of travel or waxing position d while sliding on the first portion 16*a*. In order to cause the rotation of the wax roll and mounting sleeve through the contact of the travelling yarn with the wax mounting sleeve, it is required that the yarn in the position d be allowed to come in contact with the wax mounting sleeve for at least half the time during which the yarn completes each cycle of the reciprocal transverse motion. Therefore, it is desirable that the position of the notch 11*c* with respect to the horizontal direction be as close as possible to the rotational axis of the wax mounting sleeve 16, so far as the yarn in position c can be automatically brought into position d due to its transverse motion. Transfer of the yarn from position c to d depends mainly on the magnitude of the yarn tension and therefore, the end face of the first portion 16*a* of the wax mounting sleeve 16 can be of a conical shape, as shown at 16' in FIG. 6B, to facilitate the transfer of the yarn.

The yarn which is thus brought into the position d can contact not only the end face of the wax roll constantly, but also the cylindrical surface of the first portion 16*a* of the wax mounting sleeve 16, for at least half the time during which the yarn completes each cycle of the reciprocal transverse motion. This ensures that the wax roll 17 completes a smooth and uniform rotation and performs a uniform waxing during the overall effective life thereof.

It is noted that the yarn catching means which is shown in FIG. 1B also assists the yarn restricting arm 11*b* in automatically placing the yarn in the proper waxing position d in the same manner as was described with reference to FIG. 1A.

In addition, it is to be understood that, according to this invention, the wax mounting sleeve 16 has the flange-like portion acting as positioning means for defining the axial position of the wax roll, so that any wax roll can be mounted in the same position of the wax mounting sleeve. Further, since the yarn contacts the wax roll at a region which is remote from the rotational axis of the wax roll, and it therefore, includes a factor which tends to cause the wax roll to swivel with respect to the wax mounting sleeve. However, the flange-like portion 19 can suppress such an unfavourable tendency. Furthermore, in the case where the wax mounting sleeve is made of plastic wearing of the support spindle, which is generally made of metallic material, can be reduced to a minimum.

Although various specific embodiments have been described above, it will be readily understood by those skilled in the art that various rearrangements of parts and modifications of parts may be accomplished without departing from the spirit and scope of the invention as defined in the appended claims. For example, the holding member 22 can be a rigid member in the case that the second cylindrical portion 20 is made of an elastic material.

Although the present invention has been described with respect to the open end spinning machine, the invention can also be equally applied to various spinning machines, such as ring spinning machines, winding machines, twisting machines, etc.

What we claim is:

1. A device for waxing a yarn which is fed from a supply of yarn through a waxing position to a yarn winding-up mechanism in a spinning machine, said waxing device comprising:

a wax body having opposite end faces and an opening extending axially therethrough between said end faces;

support means for rotatably supporting said wax body, said support means including, a sleeve member having a cylindrical portion and a stop adjacent said cylindrical portion, said hollow sleeve member inserted into said opening of said wax body for having a part of said cylindrical portion project from one end of said opposite end faces of said wax body remote from said stop, said hollow sleeve member having a stationary spindle member extending thereinto for supporting said hollow sleeve member for rotation about said spindle member, and said stop positioned adjacent the other of said opposite end faces of said wax body for maintaining said wax body at a defined axial position relative to said sleeve member;

connecting means for fixedly and integrally connecting said wax body and said hollow sleeve member; and whereby said waxing device is positioned between the yarn supply and the yarn winding-up mechanism for having said yarn contact a surface of said cylindrical portion of said hollow sleeve member and said one end of said opposite end faces of said wax body as said yarn is fed from the yarn supply.

2. A device as set forth in claim 1, wherein said stop has a cylindrical shape having an outer diameter larger than the outer diameter of said cylindrical portion of said sleeve member for preventing swivel movement of said wax body relative to said sleeve member.

3. A device as set forth in claims 1 or 2, wherein said sleeve member includes a hollow portion having an inner diameter smaller than the inner diameter of said cylindrical portion, said hollow portion extending from said stop in a direction opposite to said cylindrical portion.

4. A device as set forth in claim 3, wherein said hollow portion of said sleeve member has a cylindrical shape.

5. A device as set forth in claim 3, wherein said cylindrical portion, stop portion and hollow portion of said sleeve member are formed as one piece.

6. A device as set forth in claim 1, wherein at least said cylindrical portion of said sleeve member is made of plastic.

7. A device as set forth in claim 1, wherein said connecting means for fixedly and integrally connecting said wax body and said hollow sleeve member comprises a plurality of axially extending projections disposed around said cylindrical portion of said hollow sleeve member and at positions adjacent said stop.

8. A device as set forth in claim 7, wherein said cylindrical portion of said hollow sleeve member and said axially extending projections are formed as one piece.

9. A device as set forth in claim 1, wherein said spindle member is loosely fitted into said sleeve member and has a length sufficient for allowing said sleeve member and said wax body to slide therealong for a predetermined length in an axial direction away from said yarn in the waxing position.

10. A device as set forth in claim 9, wherein holding means are provided for holding said sleeve member and said wax body, after having been slid along said spindle member said predetermined length.

11. A device as set forth in claim 10, wherein said holding means comprises a resilient member for resiliently engaging said sleeve member, after having been slid said predetermined length.

12. A device as set forth in claim 10, wherein said holding means comprises a rigid member and said sleeve member comprises a resilient member.

13. A device as set forth in claim 1, further comprising yarn catching means for catching the yarn fed from the supply of yarn, and guiding means for cooperating with said yarn catching means for guiding the yarn into the waxing position and causing said yarn to reciprocate in a transverse motion.

14. A device as set forth in claim 13, wherein said guiding means comprises a plate-like member disposed between said yarn catching means and said wax body, said plate-like member including a yarn restricting notch extending substantially parallel to the rotational axis of said sleeve member and having an open end, and a yarn guide surface which is coextensive with said notch at the open end of said notch at its extremity for having yarn, sliding along said yarn guide surface, driven into said notch, said notch being disposed in a position for allowing the yarn in the waxing position to contact said cylindrical surface of said cylindrical portion of said sleeve member for at least half the time during which each cycle of said reciprocal transverse motion of the yarn is completed.

15. A device as set forth in claim 14, wherein said yarn guide surface is located ahead of the end faces of said cylindrical portion of said sleeve member in the axial direction.

16. A device as set forth in claim 14, wherein said support means comprises a bracket having a substantially vertically extending arm and a substantially horizontal extending arm and mounted on the spinning machine, said spindle member being mounted at one end of said vertical arm.

17. A device as set forth in claim 16, wherein said plate-like member of said guide means comprises said horizontal arm of said bracket.

18. A device as set forth in claim 16, wherein said bracket is inclined at a predetermined angle with respect to the horizontal plane for urging said wax body toward the waxing position of the yarn.

19. A device as set forth in claim 18, wherein said spindle member has a stop having a diameter smaller than the inner diameter of said cylindrical portion of said sleeve member and larger than the inner diameter of said stop of said sleeve member, said spindle member stop located at the end of the spindle member adjacent said part of said cylindrical portion of said sleeve member which projects from said wax body.

20. A device as set forth in claim 12, wherein the end face of said cylindrical portion of said sleeve member has a conical shape.

* * * * *